US007395900B2

(12) United States Patent
Murray et al.

(10) Patent No.: US 7,395,900 B2
(45) Date of Patent: Jul. 8, 2008

(54) PORTABLE WHEELCHAIR LIFT

(76) Inventors: Richard Murray, P.O. Box 262, Sayville, NY (US) 11782-0262; Yohann Littee, 625 Main St., Apartment 724, New York, NY (US) 10044

( * ) Notice: Subject to any disclaimer, the term of this patent is extended or adjusted under 35 U.S.C. 154(b) by 238 days.

(21) Appl. No.: 11/045,436

(22) Filed: Jan. 28, 2005

(65) Prior Publication Data

US 2006/0182581 A1 Aug. 17, 2006

(51) Int. Cl.
*B66B 9/08* (2006.01)
*B66B 9/16* (2006.01)

(52) U.S. Cl. ..... 187/200; 187/201; 187/202; 187/240; 187/242; 187/243

(58) Field of Classification Search ..... 187/200–202, 187/240–244
See application file for complete search history.

(56) References Cited

U.S. PATENT DOCUMENTS

| | | | | | |
|---|---|---|---|---|---|
| 336,414 | A * | 2/1886 | Kerr | 182/10 |
| 866,475 | A * | 9/1907 | Keimer | 187/241 |
| 2,757,756 | A * | 8/1956 | Warry | 187/243 |
| 4,015,686 | A * | 4/1977 | Bushnell, Jr. | 182/148 |
| 4,183,423 | A * | 1/1980 | Lewis | 182/103 |
| 4,458,785 | A * | 7/1984 | Bushnell, Jr. | 187/231 |
| 4,793,437 | A * | 12/1988 | Hanthorn | 182/102 |
| 5,105,913 | A * | 4/1992 | Neubauer et al. | 187/243 |
| 5,269,227 | A * | 12/1993 | Warren et al. | 105/29.1 |
| 5,584,363 | A * | 12/1996 | Curtin et al. | 187/243 |
| 5,947,231 | A * | 9/1999 | Raab et al. | 187/200 |
| 6,182,798 | B1 * | 2/2001 | Brady et al. | 187/282 |
| 6,371,449 | B1 * | 4/2002 | Chamberlain | 254/387 |
| 6,533,070 | B1 * | 3/2003 | Elrod | 182/103 |
| 2005/0098387 | A1 * | 5/2005 | Penn et al. | 187/262 |

* cited by examiner

*Primary Examiner*—Peter M. Cuomo
*Assistant Examiner*—Eric Pico
(74) *Attorney, Agent, or Firm*—Scully, Scott, Murphy & Presser, P.C.

(57) ABSTRACT

Systems and methods for lifting a wheelchair in non-residential indoor facilities. Guide rails extend from a wheeled-base and include a bearing and transmission system for raising and lowering a platform on which a wheelchair occupant travels. The bearing system is powered by a hydraulic cylinder with a cable or chain connected to the bearing system. The chain or cable traverses over idler pulleys at various positions about the guide rails and connects to the bearing system at one end and to one of the guide rails at another end. As the hydraulic cylinder is operated, the lifting cable translates the bearing system linearly through the guide rails, which in turn lifts the platform to a desired level. The platform may be adjusted to maintain a generally level orientation even as the guide rails are tilted to accommodate inclinations. Additional outriggers and/or supports may be provided to increase balance and stability of the lift. The weight of the wheeled-base is generally significantly greater than the combined weight of all other components of the lift in order to also provide increased balance and stability to the lift, especially when the guide rails are tilted to accommodate a staircase or other inclined situation.

15 Claims, 12 Drawing Sheets

FIG. 1
(PRIOR ART)
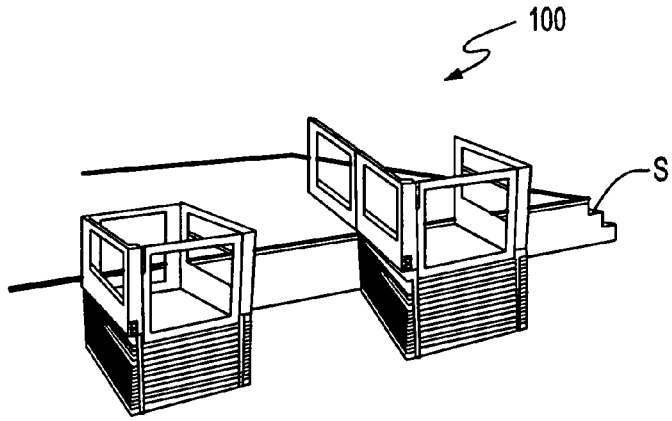
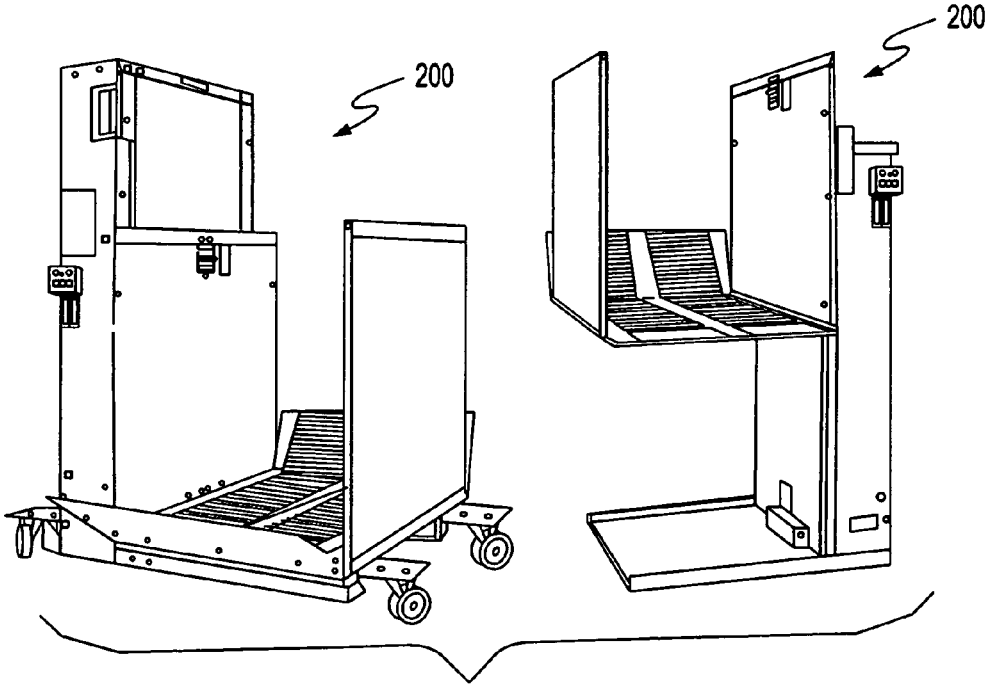
FIG. 2 (PRIOR ART)

PORTABLE WHEELCHAIR LIFT

BACKGROUND OF THE INVENTION

1. Field of the Invention

The invention generally relates to systems and methods for lifting a person in a wheelchair. More particularly, the invention relates to a portable wheelchair lift that can negotiate a sheer change in elevation or inclination, and that is easily stored and maneuvered for use in non-residential indoor facilities.

2. Related Art

Commercially available wheel chair lifts have been developed to help mobility-impaired persons negotiate elevation differences encountered in indoor and outdoor environments. FIGS. 1-4 illustrate exemplary wheelchair lifts currently available.

FIG. 1 illustrates a portable wheelchair lift 100 provided by Ascention (www.wheelchairlift.com). The lift 100 is designed to provide a direct vertical lift so that a wheelchair occupant can access a platform or stage S. The lift 100 is not intended to negotiate stairs or inclined situations. The size, weight and bulky configuration of the lift pose storage and maneuverability problems. For example, the lift is not compact enough to fit through a standard doorway.

FIG. 2 illustrates a portable wheelchair lift 200 provided by Access Industries (www.accessind.com). The lift 200 can translate a wheelchair vertically 6 feet, but is not adaptable for stairs or other inclined situations. The primary use of the lift 200 is for transporting a wheelchair occupant to stages and elevated platforms.

FIG. 3 illustrates a portable wheelchair lift 300 available from American Access (www.wheelchairramps.com). Again, the lift 300 is adaptable to elevated platforms or other vertical rises, but is not intended for use with stairs or other inclined situations.

FIG. 4 illustrates a portable wheelchair lift 400 available from Adaptive Engineering Ltd. (www.adaptive.ab.ca). The lift 400 is very large and intended generally for outdoor use to board/de-board a disabled person from an aircraft. Due largely to its cumbersome size, the lift 400 is able to raise and translate an occupied wheelchair from ground-level to the aircraft, or vice-versa, thereby negotiating the incline of the boarding stairs by by-passing the stairs. The size of the outdoor lift 400 renders transport difficult and storage challenging.

Other conventional wheelchair lifts, such as those disclosed in U.S. Design Pat. No. D440,728, or U.S. Pat. Nos. 5,553,990, 6,585,474 and 6,086,314, for example, are either not portable, not intended for indoor use, or both. Still other known wheelchair lifts often comprise configurations that violate current ASME Safety Standards, however, with respect to non-residential indoor environments In view of the above, a need exists for systems and methods that provide a compact, portable wheelchair lift that is easily maneuverable and storable for use in non-residential indoor environments. A need further exists for such systems and methods of providing a compact, portable wheelchair lift that enables a wheelchair occupant to negotiate elevation and inclination changes represented by stages, staircases, or other elevated and/or inclined surfaces.

SUMMARY OF THE INVENTION

The systems and methods of the invention provide a portable wheelchair lift that accommodates vertical and inclined lift situations. The systems and methods of the invention comprise at least a lower frame, a pair of inclinable guide rails extending from the lower frame, a platform adjustably suspended to a desired orientation between the guide rails by a platform angular adjustment system, a bearing system slidable within each of the guide rails, the bearing systems including a bearing link rotatably connecting the platform to the bearing system, and a power transmission system for translating the platform via the bearing system along the guide rails, the platform ideally being maintained in the horizontal position to transport a wheelchair and occupant to a raised platform. Ideally, the weight of the lower frame is significantly more than the combined weight of the guide rails and platform components in order to help maintain the balance of the lift even as the guide rails are inclined. Additionally, the wheelchair lift is configurable to a compactness that allows for easy transport and storage.

The lower frame generally comprises a pair of bi-furcated legs and a cross-member joining the bi-furcated legs. Each bi-furcated leg is comprised of a first section and a second section. Casters, or other conventional rollers, are provided on an underside of the first section of each bi-furcated leg to provide easy transport and storage of the lift.

The platform is generally square or rectangular in shape, comprised of a tubular steel frame topped by a substantially solid panel. Some other embodiments of the platform include a pair of hinged panels, whereby one panel of the platform pivots about a hinge to safeguard against undesirable movements of a wheelchair occupant on the platform as the platform is raised or lowered. Other embodiments of the platform may include permanent or modular walls and doors to protect the occupant during transport. Still other embodiments of the platform include an obstruction detecting/halting device, whereby lowering of the platform is halted if obstructions are detected.

The power transmission system comprises a roped hydraulic power system having a hydraulic cylinder mounted to an outside surface of one of the guide rails, a series of idler pulleys positioned at various locations of the lift, and a lifting chain or cable. The lifting chain or cable is fixed at one end to the hydraulic cylinder mounting bracket and is fixed at another end to the bearing system. Movement of the hydraulic cylinder thus causes the lifting cable to raise or lower the platform according to the movement of the bearing system to which the lifting cable is fixed.

Each guide rail houses a bearing block to which the platform is rotatably mounted. The platform is also fixedly mounted to the platform angular adjustment system. In this manner, the platform can maintain a generally horizontal orientation even as the bearing block translates up or down inclined guide rails.

In some embodiments of the systems and methods of the invention, the bearing system comprises a bearing block that slides inside each of the guide rails. Each bearing block further comprises a roller on all sides of the bearing block. The rollers enable the bearing blocks to slide inside a corresponding one of the guide rails and transmit the load of the platform to the guide rails with minimal frictional losses. In other embodiments of the systems and methods of the invention, the bearing system comprises an inverted V-rail extending along an inside surface of each guide rail, and a set of V-grooved wheels provided on the bearing block that slide along a corresponding one of the inverted V-rails.

In still other embodiments of the systems and methods of the invention, supports, braces, leveling feet, or outriggers are provided to add strength, stability and/or balance to the lift.

The various embodiments of the system and methods of the invention described herein provide several advantages over prior known devices and methods of operation including portability, compactness conducive to storing, and versatility. In addition, the various embodiments of the systems and methods of the invention enable a mobility-impaired person to negotiate changes in elevation and inclination in non-residential indoor environments using a portable wheelchair lift.

The above and other features of the invention, including various novel details of construction and combinations of parts, will now be more particularly described with reference to the accompanying drawings and claims. It will be understood that the various exemplary embodiments of the invention described herein are shown by way of illustration only and not as a limitation thereof. The principles and features of this invention may be employed in various alternative embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

FIG. 1 illustrates a commercially available prior art wheelchair lift.

FIG. 2 illustrates another commercially available prior art wheelchair lift.

DETAILED DESCRIPTION OF THE INVENTION

Figure 3:
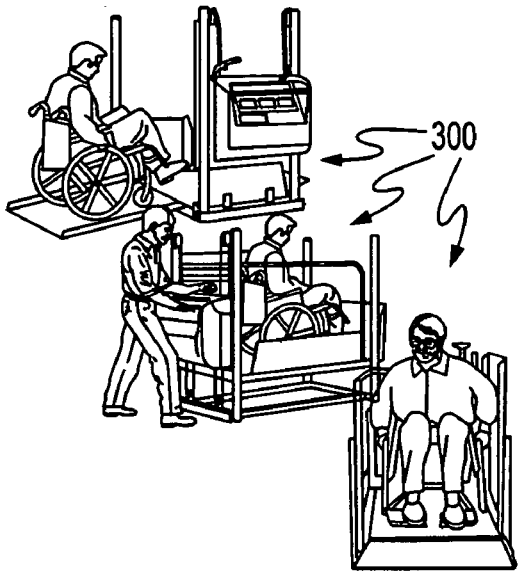
FIG. 3 (PRIOR ART)
FIG. 3 illustrates a third commercially available prior art wheelchair lift.
Figure 4:
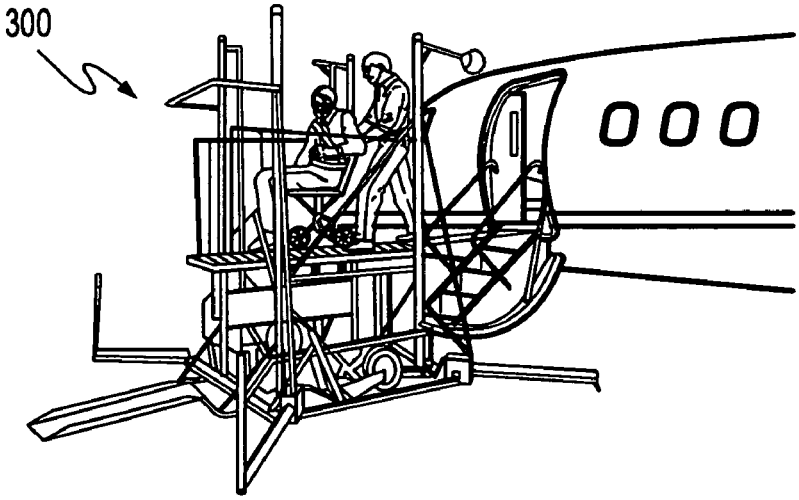
FIG. 4 (PRIOR ART)
FIG. 4 illustrates a fourth commercially available prior art wheelchair lift.
Figure 5:
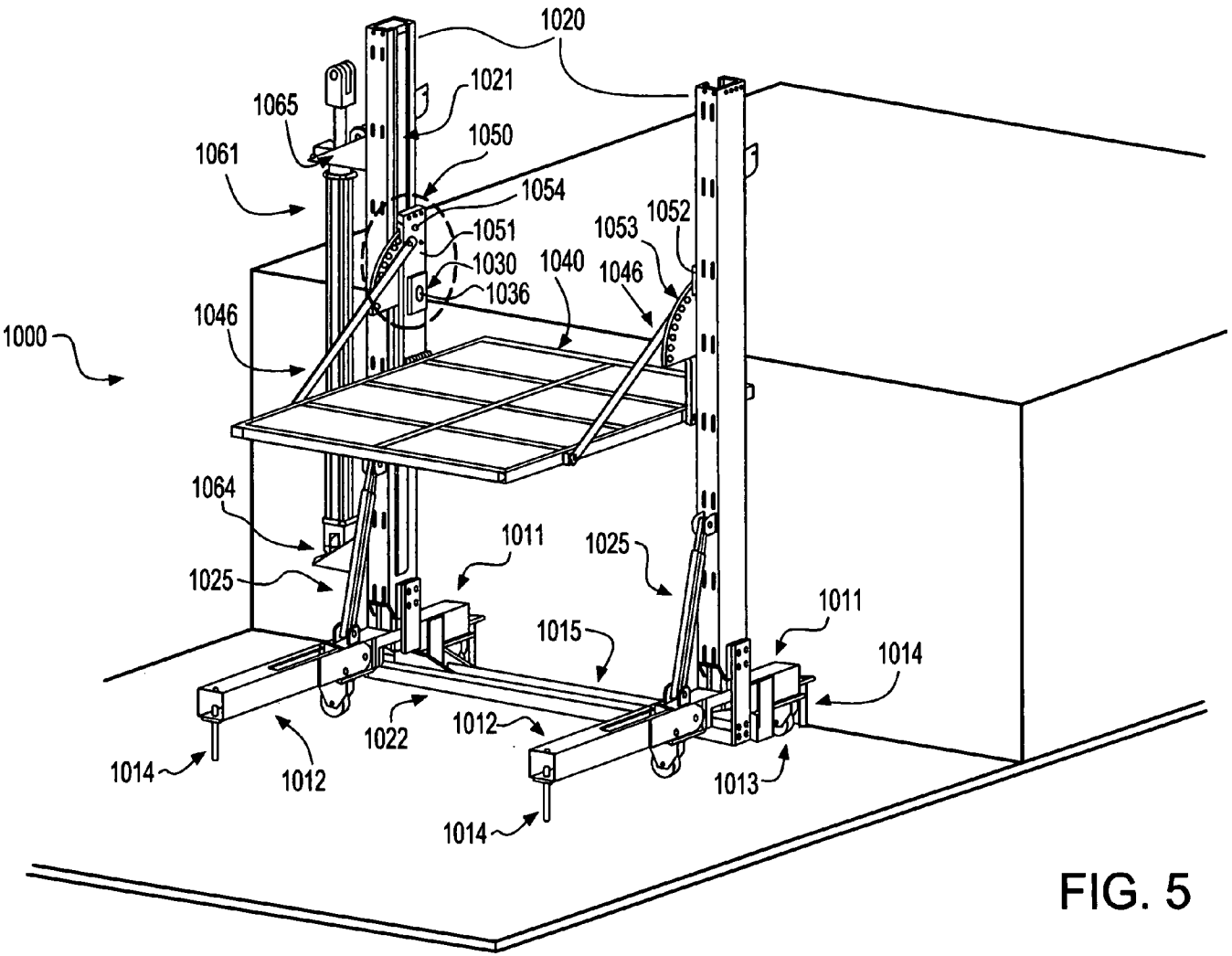
FIG. 5 illustrates a wheelchair lift elevated vertically according to the invention.

FIG. 5 illustrates a perspective view of a portable wheelchair lift 1000 according to the systems and methods of the invention. The lift 1000 generally comprises a base, or lower frame, having a set of bi-furcated legs 1010 (FIG. 8) and a cross-member 1015 extending between the bi-furcated legs, a guide rail 1020 extending upward from a respective one of the bi-furcated legs, and a platform adjustably connected to a bearing system 1030 housed in each of the guide rails 1020.

Referring still to FIG. 5, each bi-furcated leg 1010 is further comprised of a first section 1011 and a second section 1012. The bi-furcated legs 1010 are generally parallel to one another, and the cross-member 1015 extends generally perpendicularly between the bi-furcated legs. The first sections 1011 of each bi-furcated legs 1010 includes casters 1013, or other conventional rollers, on an underside thereof to increase the storage and transport options of the lift. Each bi-furcated leg is also outfitted with leveling feet 1014. An adjustable leveling foot 1013 is provided, for example, at the outer ends of each section 1011, 1012 of each bi-furcated leg for use during machine setup. When operated, the leveling feet 1014 may be threadably, slidably, or otherwise adjusted to level the lift 1000 by contacting the floor with one or more of the leveling feet 1014. Leveling the lift 1000 in this manner disengages the casters 1013, which helps to prevent undesirable translation of the lift 1000 along the floor.

Figure 6:
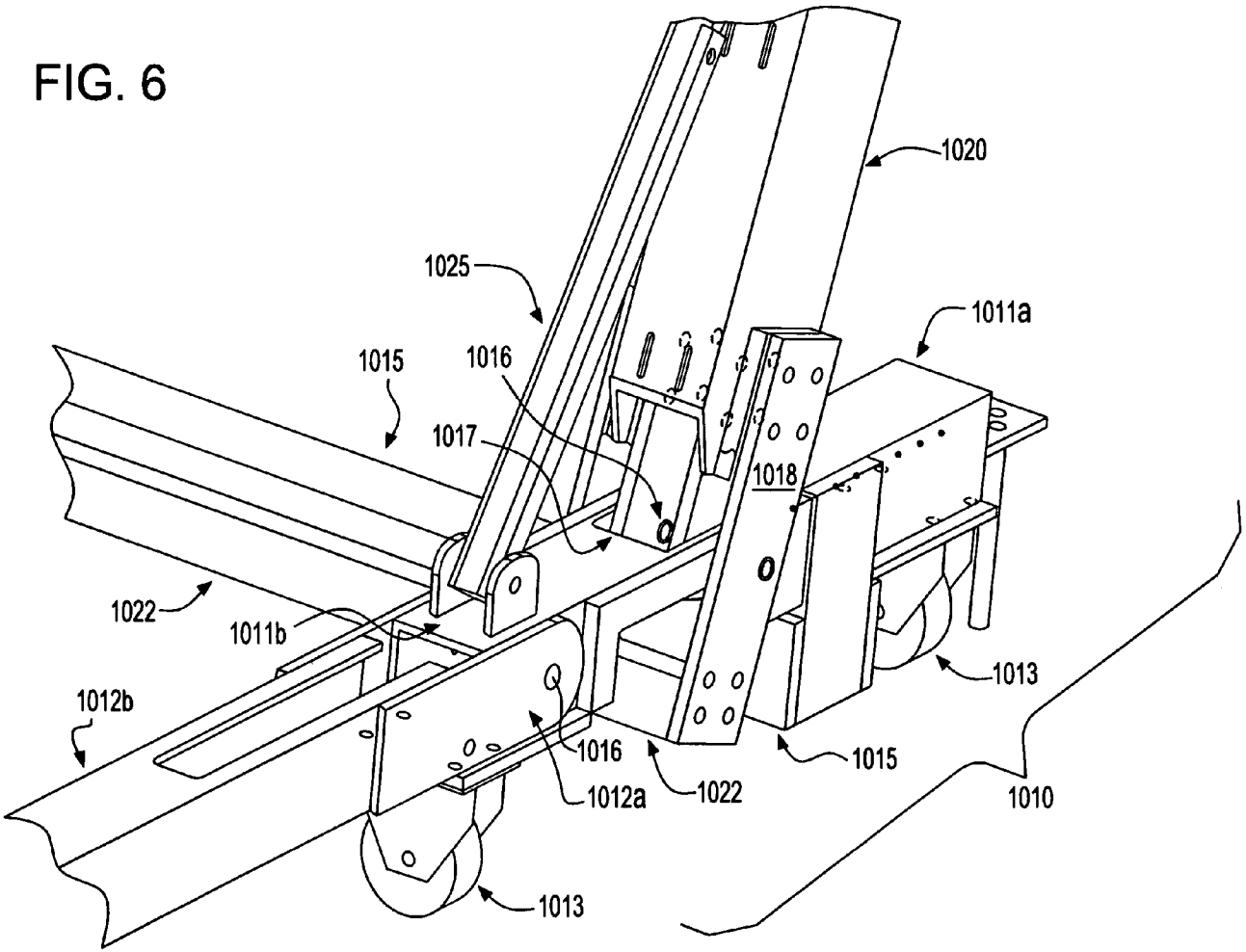
FIG. 6 illustrates a portion of a lower frame and guide rail according to the invention.

FIG. 6 illustrates in more detail the interface of a lower end of one of the guide rails 1020 with one of the bi-furcated legs 1010. As shown in FIG. 6, the guide rails 1020 and bi-furcated legs 1010 are generally tubular shaped steel, for example, although the artisan will readily appreciate that other shapes and materials may be used for the various components of the lift in addition to, or otherwise than, as specified or described herein provided adequate weight and strength are provided by the various shapes and materials used. The weight of the bi-furcated legs 1010 and the cross-member 1015 is preferably significantly more than the combined weight of the guide rails 1020 and the platform 1040 in order to aid balance and stability of the lift 1000, particularly when the guide rails 1020 are tilted to negotiate an inclination such as a staircase. As discussed below with reference to FIG. 8 however, once upper braces 1029 are engaged the stability of the lift is greatly increased regardless of mass ratios. The artisan will appreciate that materials of appropriate weights are thus most preferably used to comprise the various components of the lift according to the invention.

Referring still to FIG. 6, the first section 1011 of each leg 1010 is comprised of a first end 1011*a* and a second end 1011*b*. The second section 1012 of each leg 1010 is similarly comprised of a first end 1012*a* and a second end 1012*b*. The second end 1011*b* of each first section 1011 is fitted into the first end 1012*a* of a corresponding second section 1012 of one of the bi-furcated legs 1010. A pivot pin 1016 secures the first section 1011 and the second section 1012 of each leg 1010 to one another. The second section 1012 of each bi-furcated leg 1010 may thus pivot relative to the first section 1011 of a respective one of the bi-furcated legs. A set pin (not shown) is provided to lock the two sections 1011 and 1012 rigidly in a straight position.

Figure 7:
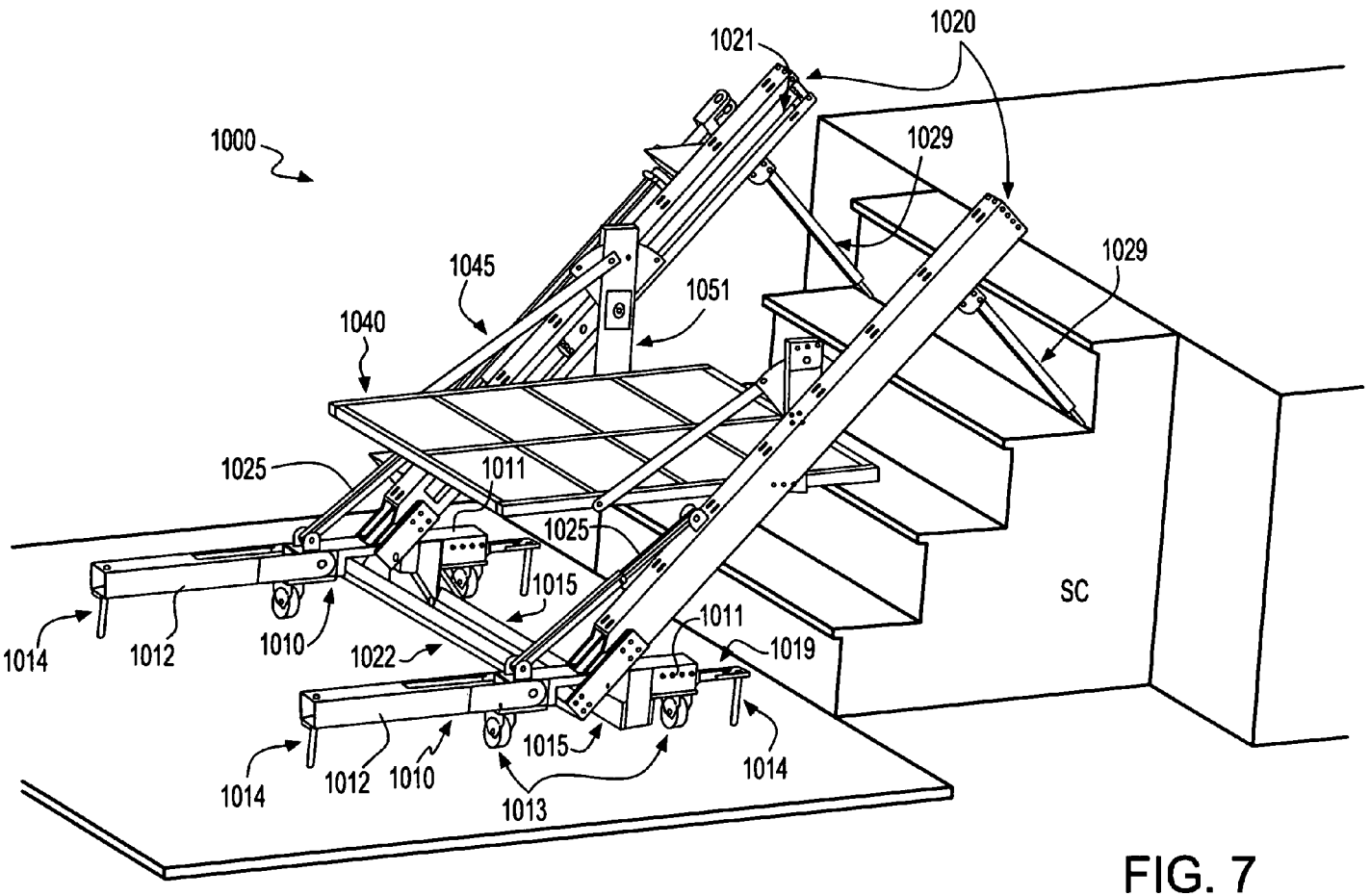
FIG. 7 illustrates a wheelchair lift elevated at an incline according to the invention.

Still referring to FIG. 6, a cut-out portion 1017 is provided on an upper surface of each first section 1011. The cut-out portions 1017 each receives a lower portion of a respective one of the guide rails 1020, as shown in FIG. 6. The cut-out portion 1017 extends along the upper surface of each first section 1011 of the legs 1010 a distance long enough to accommodate the maximum inclined positions of the guide rails 1020 when the guide rails 1020 are negotiating a staircase SC, or other inclined elevation situation, for example, as shown in FIG. 7. If desired, plates 1018 may be attached to the lower end of each guide rail 1020 in conventional manner in order to extend from the lower end of each guide rail 1020 and straddle the outside of the first section 1011 of each leg 1010. The plates 1018, where provided, help to better secure or retain the guide rails 1020 in the respective cut-out portion 1017 they are received within.

Referring back to FIG. 5 again, a guide rail 1020 extends upwardly from each of the legs 1010. The guide rails 1020 are generally parallel to one another and house a linearly translating bearing system 1030, discussed in more detail below with reference to FIGS. 11-13 and FIGS. 16-17. A telescopic brace 1025 connects a respective one of the guide rails 1020 to the first section 1011*b* of a corresponding one of the bi-furcated legs 1010 of the lift 1000.

Still referring to FIG. 5, the platform 1040 is situated between the guide rails 1020 of the lift 1000. More specifically, the platform 1040 is connected to the bearing system 1030 housed within each guide rail 1020. A platform angular adjustment system 1050 (see circled portions of FIGS. 5 & 15 for comparable platform angular adjustment systems 1050 & 2050, respectively), comprised of platform side arms 1051, receiving plates 1052 and drilled plates 1053, which help to orient the platform as desired.

Referring again to FIGS. 5 and 10 and the connection of the platform 1040 to the bearing system 1030, platform side arms 1051 extend upwardly from the platform 1040. The platform side arms 1051 each include a receiver plate 1052 that is spaced apart a gap g from a respective one of the platform side arms 1051. Drilled plates 1053 (FIG. 5) fit within the gap g between the respective platform side arms 1051 and the receiver plates 1052. A removable pin 1054 (FIG. 5) extends through holes provided in each of the platform side arms 1051, receiver plates 1052 and drilled plates 1053 to rigidly fix the platform 1040 to the drilled plates 1053, the platform side arms 1051 and the receiver plates 1052, when the holes are appropriately aligned relative to one another.

At the same time, the platform 1040 is rotatably mounted to the bearing system 1030 housed within each guide rail 1020. More specifically, the platform is mounted to each respective bearing system by a hole or cuff 1053*a* (not shown)(see FIG. 17 for comparable cuff 2053*a*) provided in each drilled plate 1053. The hole or cuff 1053*a* receives a bearing link 1036 of the respective bearing systems 1030 in each guide rail 1020 (FIGS. 11-13 & 16-17). Receiving the respective bearing links 1036 in this manner rotatably connects the platform 1040 to the bearing system 1030 and permits the platform to maintain its desired orientation, for example horizontal orientation, even as the bearing systems 1030 translates the platform 1040 along guide rails 1020 that are inclined in order to negotiate a staircase or other raised platform.

As shown in FIG. 5, the platform 1040 is vertically elevated along the guide rails 1020 to raise the platform 1040 to the level of a stage S. The guide rails 1020 are thus vertically upright or generally perpendicular relative to the horizontally oriented platform 1040. Elevating the platform 1040 vertically in this manner is useful to accommodate positioning a wheelchair occupant from ground level to a raised stage S, for example, where no other wheelchair access is available.

FIG. 7 shows the case where the platform 1040 of the wheelchair lift 1000 is elevated in a horizontal position though the guiderails 1020 are at an inclined position relative to the platform 1040. Elevating the platform 1040 in this manner is useful to bypass a staircase SC that otherwise provides access to a raised stage S. Elevating the platform 1040 in this manner includes the extension of telescopic braces 1025 that connect the guide rails 1020 to the first sections 1011*b* of a respective one of the bi-furcated legs. The degree of extension of the extendible braces 1025 determines the degree of inclination the guiderails 1020 may assume. Elevating the platform 1040 in this manner may also include repositioning of the platform using the platform angular adjustment system 1050, i.e., the platform side arms 1051, receiver plates 1052, and drilled plates 1053, in order to maintain the generally horizontal orientation of the platform notwithstanding the inclination of the guide rails 1020. Repositioning the platform 1040 thus includes aligning and engaging the holes in the drilled plates 1053, the platform side arms 1051, and the receiver plates 1052 (the platform angular adjustment system 1050) with the pins 1054. The platform angular adjustment system 1050 is then rotatably connected to the bearing system 1030 via a bearing link 1036 received in each of the drilled plates 1053. Movement of the bearing system 1030 along the inclined guiderails 1020 determines the height or elevation of the platform 1040.

FIG. 7 also shows the use of the leveling feet 1014 and upper braces 1029 engaging the floor and staircase respectively to provide necessary stability to the machine during operation. The leveling feet 1013 are discussed above, with reference to FIG. 5. The upper braces 1029 are generally pivotably connected to an upper portion of a respective guide rail 1020 so as to extend to the staircase as shown in FIG. 6. When not in use, the upper braces 1029 may be collapsed and housed against the respective one of the guide rails 1020 the upper brace 1029 is associated with (FIG. 7).

Figure 8:
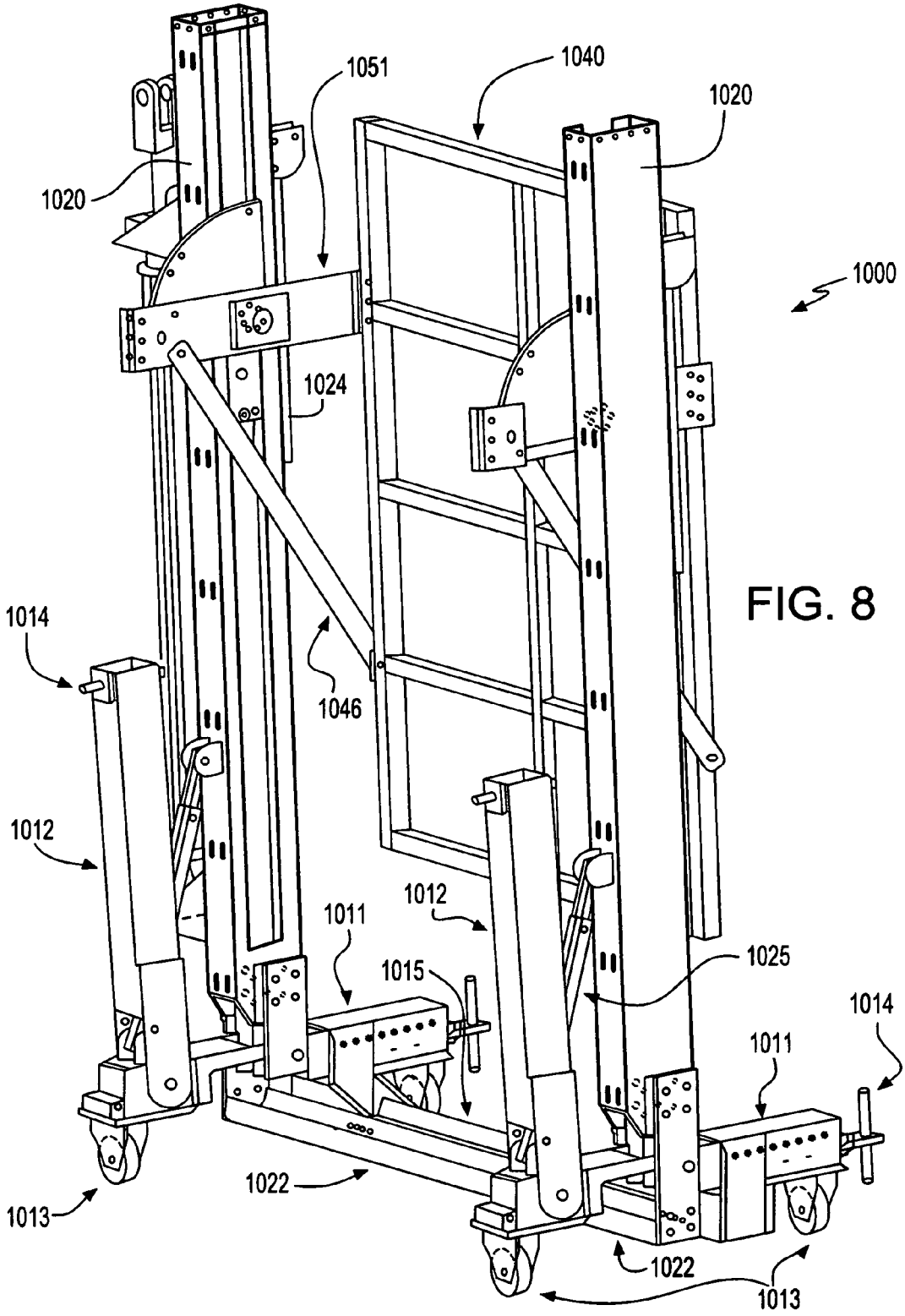
FIG. 8 illustrates a wheelchair lift in a collapsed storage and transport state according to the invention.

FIG. 8 illustrates generally the lift 1000 in a collapsed, compact state for storage and transport. As shown in FIG. 7, the guide rails 1020 are positioned in a vertically upright position generally perpendicular to first sections 1011 of the bi-furcated legs 1010, the platform 1040 is positioned in a vertically upright position generally parallel to and between the guide rails 1020 by configuring the platform angular adjustment system 1050 appropriately as shown. The second section 1012 of each bi-furcated leg 1010 is positioned in a vertically upright position parallel a lower portion of the guide rails 1020 by removing the set pin (not shown) and folding the second section 1012 of each leg upwardly toward a respective guide rail 1020. Also, the leveling feet 1014 are retracted and the upper braces 1029 collapsed. In this manner, the casters 1013, or other rollers, provided on the underside of the first-sections 1011 of the bi-furcated legs 1010 maintain contact with the ground surface to aid the transport and storage of the lift.

Figure 9:
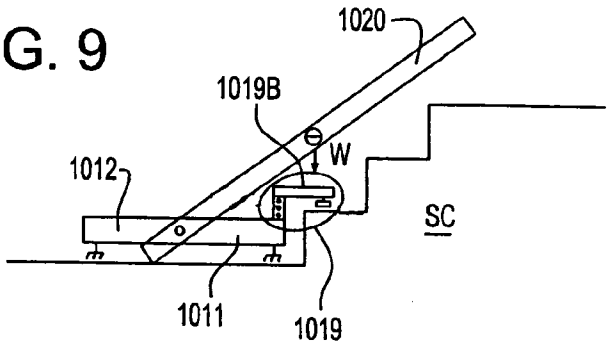
FIG. 9 illustrates an outrigger extending from the lower frame according to the invention.

FIG. 9 illustrates, in the circled area, an adjustable outrigger 1019 provided at an end of the first section 1011 opposite the end interfacing with the second section 1012 of the legs 1010. The outrigger 1019 is comprised of concentric telescopic tubing, the first outrigger part 1019*a* is permanently attached within the first section 1011 of the leg 1010, the second outrigger part 1019*b* of the telescopic outrigger 1019 nests within the first outrigger part 1019*a* and has in it a series of holes which are engaged by a pin (not shown) that also engages a single hole in the first outrigger part 1019*a*. The series of holes provides longitudinal adjustment of the outrigger 1019. The second outrigger part 1019*b* provides a plate to which a corresponding one of the leveling feet 1014 may be attached, for example. The outrigger 1019 provides increased balance and stability to the lift that is particularly useful when the guide rails 1020 of the lift are being adjusted during machine setup.

Figure 10:
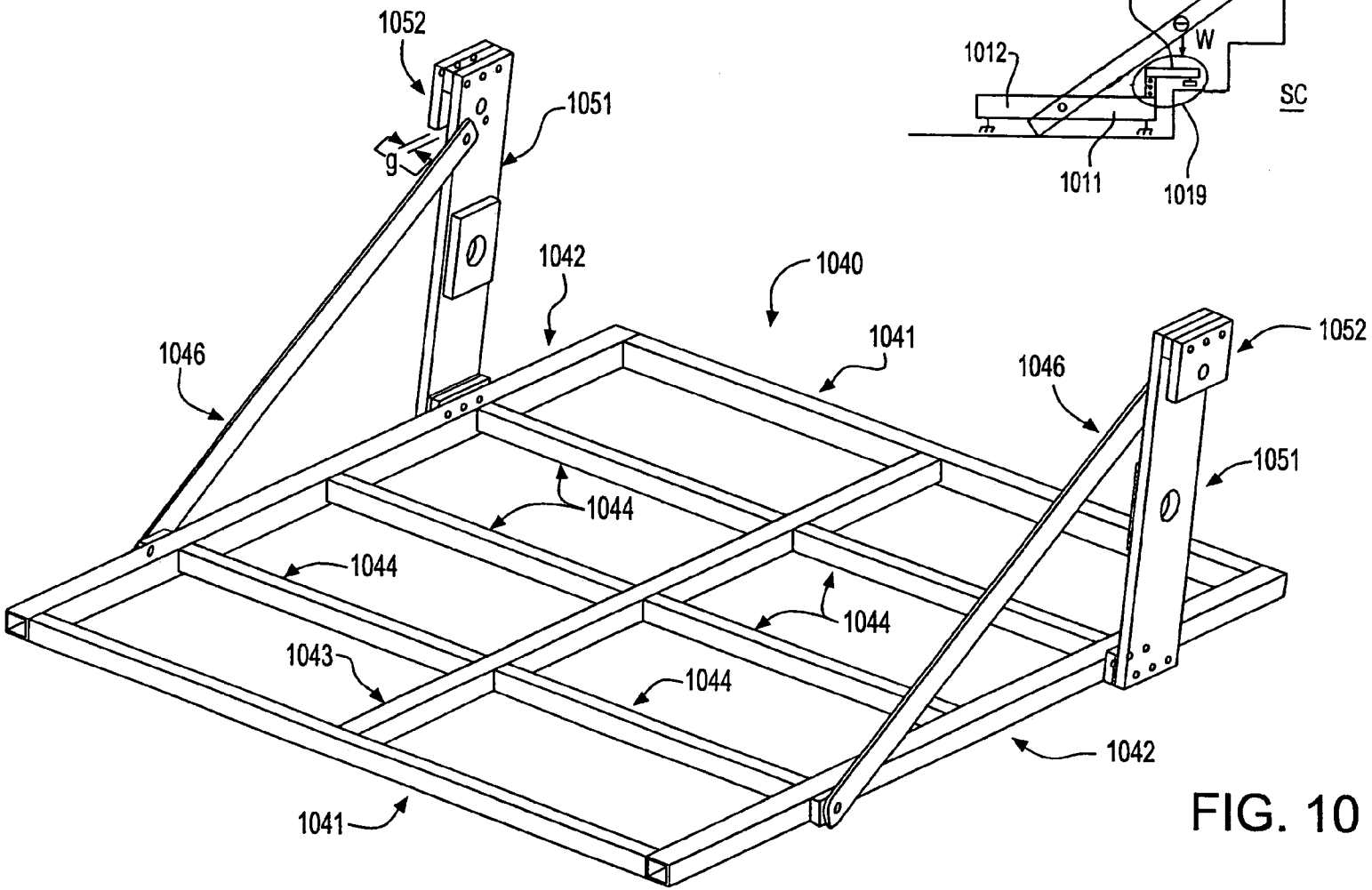
FIG. 10 illustrates a platform according to the invention, wherein the substantially solid panel of the platform is omitted to reveal the configuration of underlying steel tubing.

FIG. 10 illustrates aspects of the platform 1040 according to the invention. The platform 1040 is dimensioned such that an adult-sized wheelchair may be accommodated on the platform. As shown in FIG. 10, the platform 1040 is generally square or rectangular in shape consisting of a grid of tubular steel components comprising opposed ends 1041, opposed sides 1042, a longitudinally extending interior member 1043, and interior cross-members 1044. The platform is covered by a substantially solid panel to provide an adequate surface on which the wheelchair and occupant will be moved. The substantially solid panel is omitted from FIG. 10 to show the underlying steel components of the platform 1040. Ideally, the substantially solid panel 1040 is comprised of sheet metal, steel, wood, or some other generally solid material. Of course, the artisan will readily appreciate that a platform composed of differing or additional materials is equally suitable as a platform according to the invention, and the substantially solid panel may include raised areas or holes to provide better traction for the wheels of the wheelchair on the platform, or to provided easy removal of water, liquids, dirt or other debris from the platform.

Referring still to FIG. 10, opposed platform side arms 1051 extend upwardly from the sides 1042 of the platform. Each platform side arm 1051 includes a receiver plate 1052 to engage a corresponding one of the drilled plates 1053 of the platform angular adjustment system 1050 described above and again in more detail below with respect to FIGS. 11-13 and 16-17. A brace 1046 connects each platform side arm 1051 to a respective one of the opposed sides 1042 to provide increased strength and stability to the platform 1040.

Figure 12:
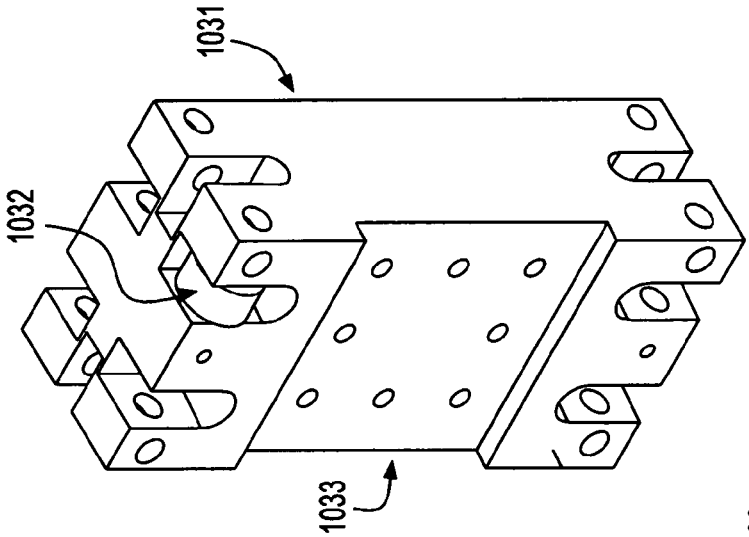
FIG. 12 illustrates a bearing block bearing system housed within the guide rails of FIG. 11 according to one embodiment of the invention.
Figure 13:
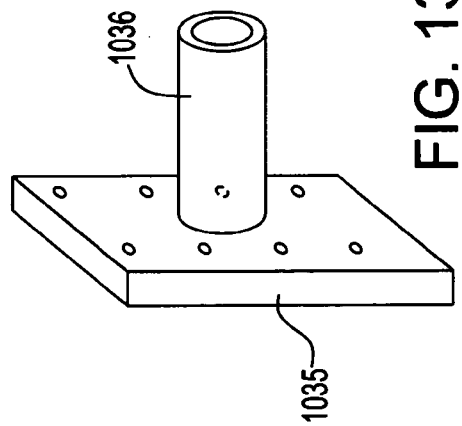
FIG. 13 illustrates a bearing link and plate compliant with the bearing block of FIG. 12 according to the invention.
Figure 11:
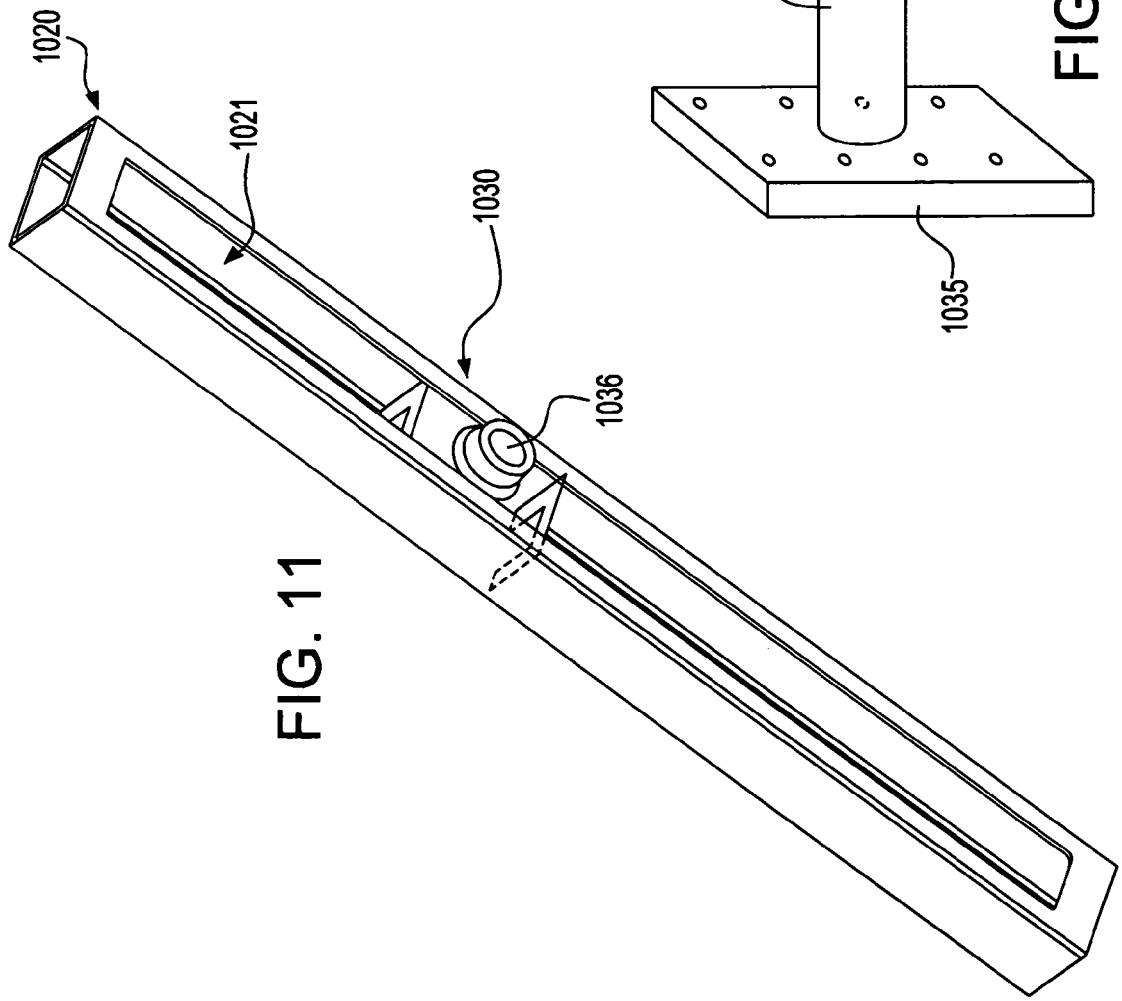
FIG. 11 illustrates a guide rail according to one embodiment of the invention.
Figure 15:
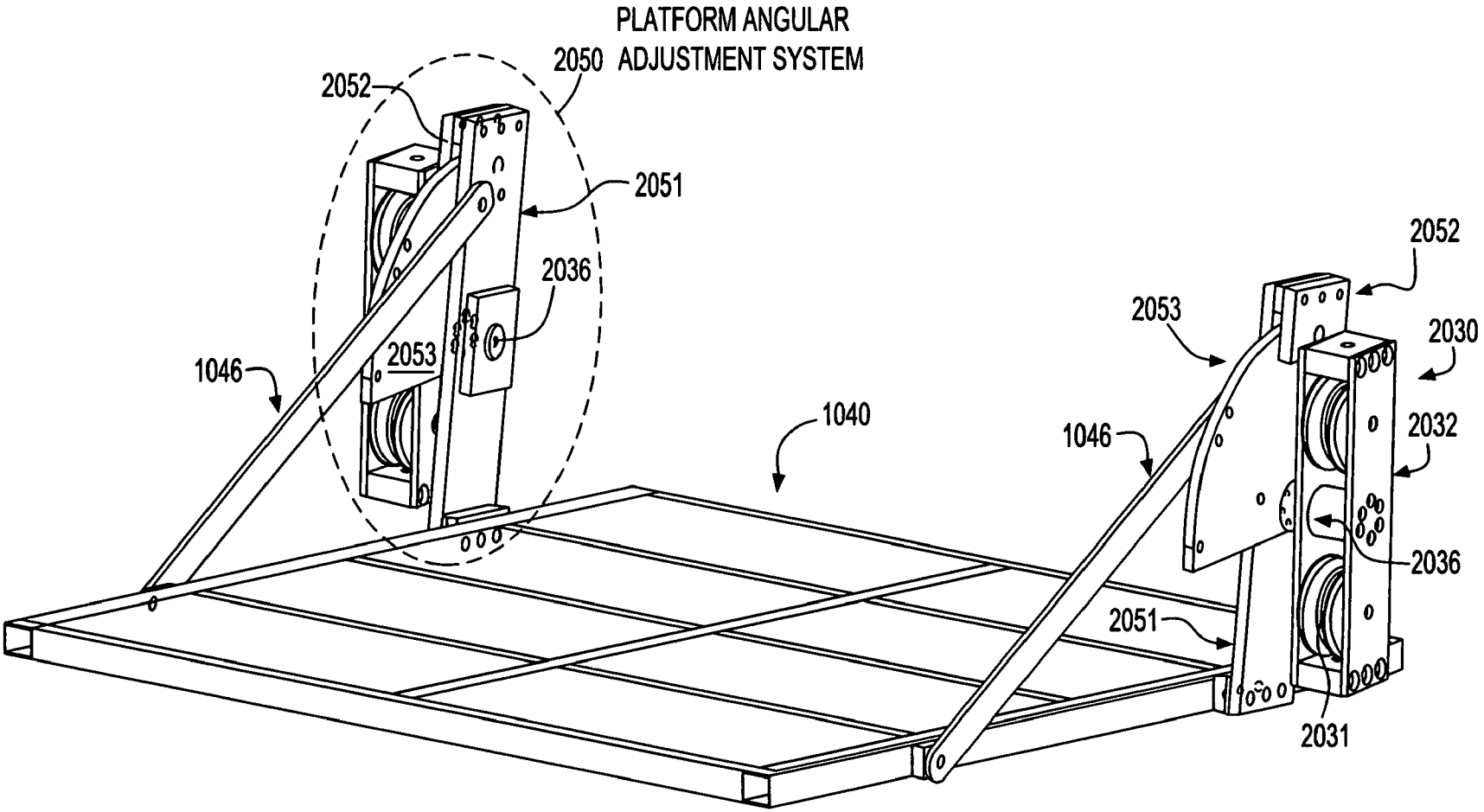
FIG. 15 illustrates the attachment of the platform to the bearing system via the platform angular adjustment system.

FIGS. 11 and 12 illustrate a guide rail 1020 and bearing system 1030 according to one embodiment of the invention. As shown in FIG. 11, each guide rail 1020 is generally rectangular in cross-section having an open-faced longitudinal channel 1021. Each guide rail 1020 houses a bearing system 1030 comprised of a bearing block 1031 (shown in greater detail in FIG. 12) according to this embodiment of the invention. The open-face of each channel 1021 permits a respective one of the bearing links 1036 extending out from a corresponding bearing block 1031 of the bearing system 1030 to attach to a corresponding one of the drilled plates 1053 of the platform angular adjustment system 1050 (FIGS. 5 & 15). Other than the open-faced channel 1021, the guide rails 1020 are generally closed-faced so as not to unnecessarily expose components of the lift system to the public or other passersby. The guide rails 1020 are preferably comprised of steel and are square or rectangular in cross section, although the artisan will appreciate that other materials and shapes known in the art are usable for various components, including the guide rails, of the invention as described herein.

As shown in FIG. 12, each bearing block 1031 includes rollers 1032 (only one roller shown) provided on all sides of the bearing block 1031. The rollers 1032 contact inside surfaces of the channel 1021 of the respective guide rail 1020 the bearing block 1031 is housed within. The rollers 1032 thus help the bearing block 1031 to slide within the guide rails 1020 and along the channel 1021 thereof when the guide rails 1020 are inclined. Frictional losses are minimized because the rollers 1032 will contact and transfer load efficiently even when the guide rails are set to an inclined orientation and the platform is maintained at a level orientation. Each bearing block 1031 is preferably comprised of aluminum and has a cross-section slightly smaller than the interior cross-section of the guide rails 1020. The rollers may be comprised of conventional materials and mechanics as known in the art. The artisan will appreciate that other materials or shapes may also be used for either or both of the bearing block or rollers.

In addition, as shown in FIG. 12, each bearing block 1031 includes an indented front surface 1033. The indented front surface 1033 corresponds in size and shape to a plate 1035, shown in FIG. 13, that is attached to the indented front surface 1033 of the bearing block 1031 by bolting or other conventional connecting means. A bearing link 1036 is welded or otherwise conventionally connected to each plate 1035. Each bearing link 1036 projects from the plate 1035 and guide rail channel 1021 (FIG. 11). At a point outside each guide rail, a corresponding one of the drilled plates 1053 is rigidly fixed to a corresponding one of the bearing links 1036 to anchor the platform angular adjustment system 1050 to the bearing system 1030. Each bearing link 1036 is then received within a corresponding one of the platform side arms 1051 of the platform 1040 such that the platform may rotate about the bearing link 1036, such as on a bushing or bearing, as best shown in FIGS. 5 and 6.

Figure 14:
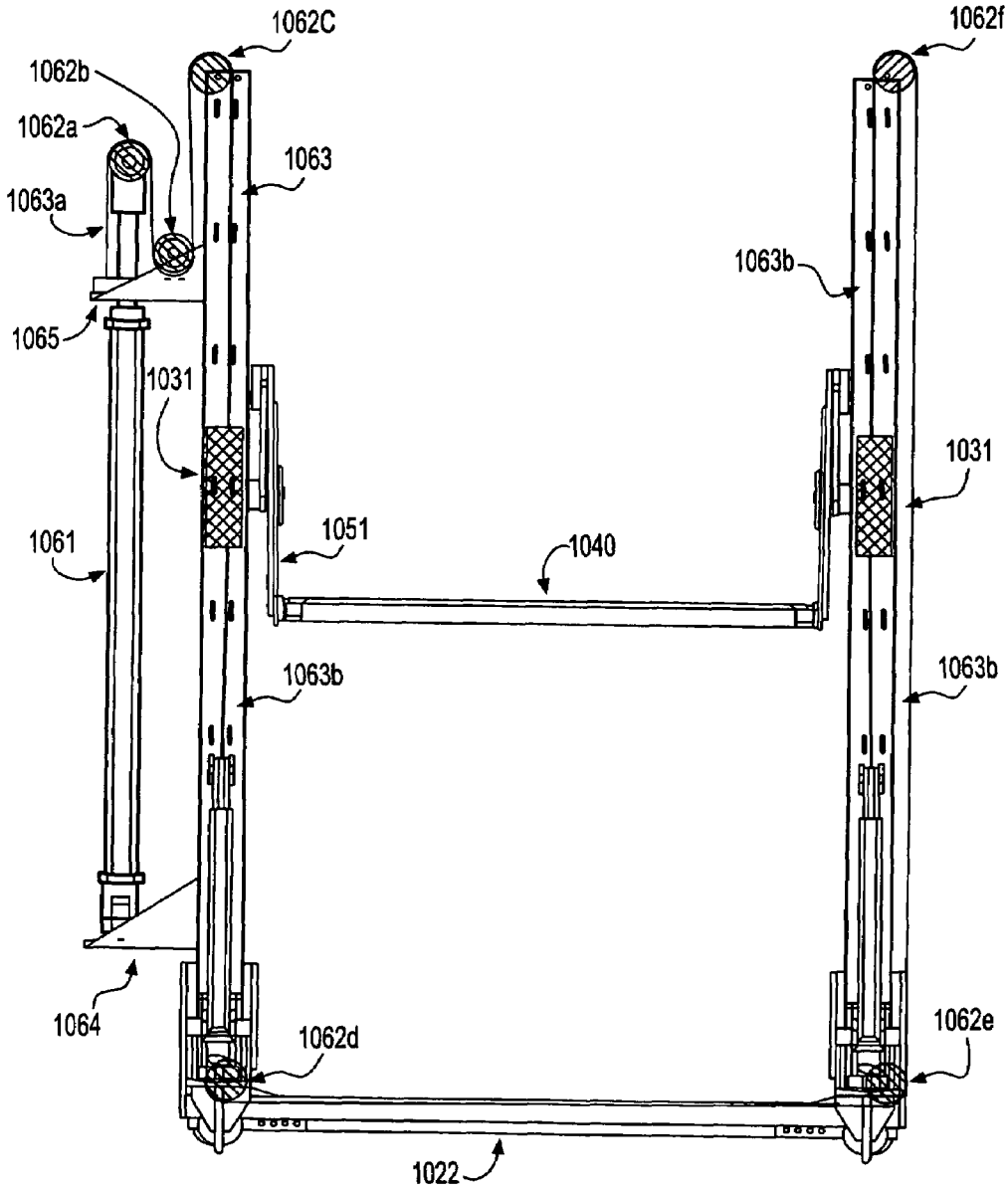
FIG. 14 illustrates schematically a power transmission system according to the invention.

FIG. 14 schematically illustrates a hydraulically-powered rope system 1060 for elevating and/or inclining the bearing system and platform 1040 according to the systems and methods of the invention thus far described herein. As shown in FIG. 14, a hydraulic cylinder 1061 is mounted to an outside surface of one of the guide rails 1020 by a lower mount 1064 and upper mount 1065. A plurality of idler pulleys 1062(*a-f*) are placed at various locations of the lift 1000, wherein idler pulley 1062*a* is positioned at the tip of the hydraulic ram, idler pulley 1062*b* is adjacent one of the guide rails 1020, idler pulley 1062*c* is adjacent a top of the same guide rail 1020, idler pulley 1062*d* is adjacent a bottom of the same guide rail 1020, idler pulley 1062*e* is parallel to the idler pulley 1062*d* and adjacent a bottom of the other guide rail 1020, and idler pulley 1062*f* is adjacent a top of the other guide rail 1020 and vertically opposite the idler pulley 1062*e*. A primary cable or chain 1063*a* extends from the upper hydraulic cylinder mount 1065, over the series of idler pulleys or sprockets 1062 (*a-c*) to connect to the upper surface of bearing block 1031 within the guide rail 1020 which holds the hydraulic cylinder 1061. From the bottom of the bearing block 1031 which resides within the guide rail that supports the hydraulic cylinder 1061, a secondary cable or chain (1063*b*) is fixed and connected to the top of the second bearing block through a series of idler pulleys or sprockets 1062(*d-f*) by exiting the bottom of first guide rail, traveling across the bottom of the machine in the guide rail synchronous link 1022, up the outside of the second guide rail, reversing direction at the top of this guide rail and terminating at the upper surface of the second bearing block. Of course, the artisan will readily appreciate that, all or portions of, the cable 1063*a* and 1063*b* and pulleys or sprockets (1062*a-f*) can be easily shielded by guarding attached to the guide rails or machine frame.

In practice, with reference to the embodiments of the invention described thus far herein, the lift 1000 in its collapsed state (FIG. 7) is maneuvered by rolling the lift using its wheelbase to the stage S, or other intended elevated location. The first ends 1011*a* of the first sections 1011 of the bi-furcated legs 1010 are placed immediately adjacent the front of the stage S, or staircase SC, to be negotiated for example. The second sections 1012 of the bi-furcated legs 1010 are then deployed from their collapsed state to rest horizontally upon the same ground surface the first sections 1011 of the bi-furcated legs 1010 are resting horizontally upon, and set pins (not shown) are used to rigidly connect the two sections 1011, 1012 in a horizontal position. Where provided, the forward outriggers 1019 are then set as close to the stair tread as practical, and the four leveling feet 1014 are set to engage the floor, thereby leveling the machine and preventing unwanted shifting of the machine which may otherwise occur if the machine were simply resting on the casters or wheels 1013. The telescopic braces 1025 are adjusted to secure the guide rails 1020 at desired angle relative to the bi-furcated legs 1010 and according to the staircase or other incline to be negotiated. The platform 1040 is then deployed from its collapsed state by disengaging the set pin 1054 in the platform angular adjustment system 1050 and pulling the platform 1040 in the direction of the second sections 1012 of the bi-furcated legs 1010 such until platform 1040 is generally parallel to the ground. At this point the concentric holes in the platform side arms 1051 and the receiver plates 1052 will align generally with a particular hole in a corresponding one of the drilled plates 1053, and the pin 1054 is reinserted to lock the platform 1040 at this horizontal position generally parallel to the floor. The hydraulic cylinder 1061 is then operated to traverse the lifting cable 1063 over the idler pulleys 1062(*a-f*) and lower the bearing blocks 1031 of the bearing system 1030, thereby lowering the platform 1040 towards the ground to receive a wheelchair occupant. If necessary, the platform 1040 may include a hinged ramp which can be used in order to ease the wheelchair occupant's entry onto the platform 1040. Thereafter, the wheelchair and occupant are secured within the platform area through the use of wheel locks on the wheelchair and by guarding or doors which the artisan will appreciate may be applied to the platform as previously stated. The platform is then raised by actuating the hydraulic cylinder thereby applying tension to the lifting cables or chains and translating the bearing blocks along the guide rails.

In the case of a directly vertical change in elevation that is to be negotiated by the wheelchair occupant, as from ground level to a stage S without a staircase SC, the telescopic braces 1025 are set such that the guide rails 1020 are perpendicular to the bi-furcated lower frame arms 1010, thus also perpendicular to the ground.

In the case of an inclined change in elevation that is to be negotiated by the wheelchair occupant, as from ground level to a stage S with a staircase SC, the lift 1000 is wheeled near the staircase, then the bi-furcated legs 1010 and leveling feet 1014 are set as described above, the forward outrigger 1019 and leveling feet 1014 being positioned as close as practicable to the staircase, possibly atop the first step. The telescopic braces 1025 are then set to one of several angles to most closely match the angle of the staircase SC, and the platform 1040 is again adjusted to the horizontal by manipulating the platform angular adjustment system 1050 as described above. To provide further machine stability during an inclined lift, the guide rail upper braces 1029 are set to contact a stair tread or other convenient surface at or near the upper landing of the obstacle.

Thereafter, the hydraulic cylinder 1061 is operated to move the bearing blocks 1031 within the channel 1021 of the guide rails 1020 in order to raise the platform 1040 to the level of the stage S, whereat the wheelchair occupant is free to exit the platform 1040 and enter the stage S. The platform 1040 maintains its level orientation relative to the ground even as the platform proceeds upwards along the inclined guide rails 1020 due to the proper setting of the platform angular adjustment mechanism.

In either case, the wheelchair occupant may use the lift 1000 to exit the stage S and return to ground level by doing the inverse of that described above, as the artisan should readily appreciate. Thereafter, the lift 1000 may be returned to its collapsed state (FIG. 7) again according to the inverse of that described above, as the artisan should readily appreciate. Once collapsed, the lift 1000 may be maneuvered as desired and returned to storage until further needed.

Figure 17:
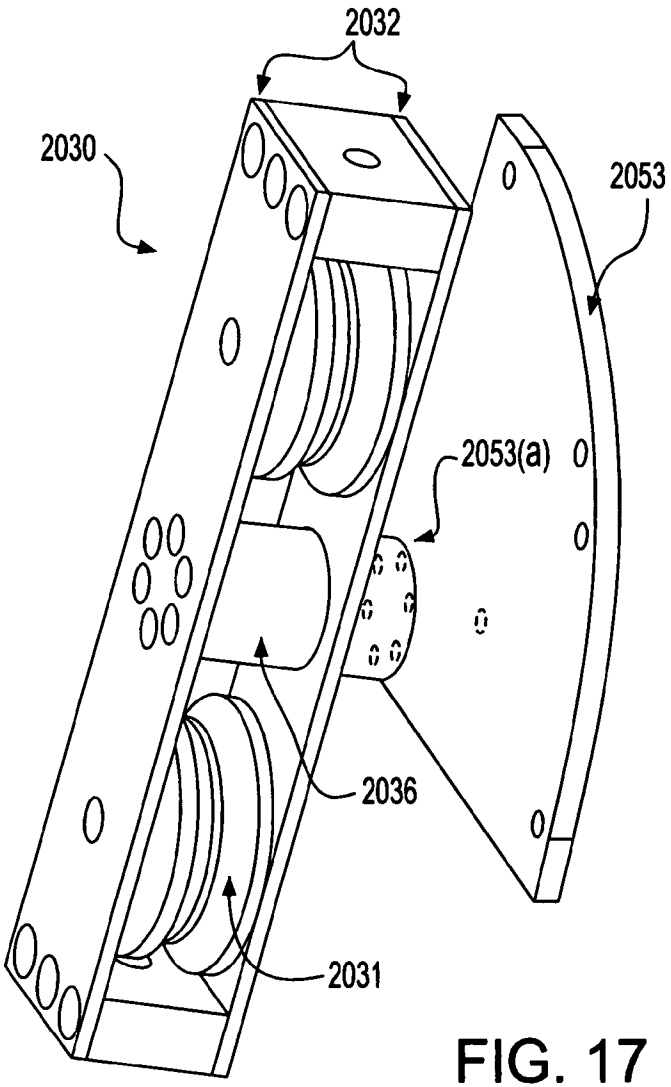
FIG. 17 illustrates a V-grooved wheel set bearing system housed within the guide rails of FIG. 16 and the attachment of the drilled plate of the platform angular adjustment system according to another embodiment of the invention.
Figure 16:
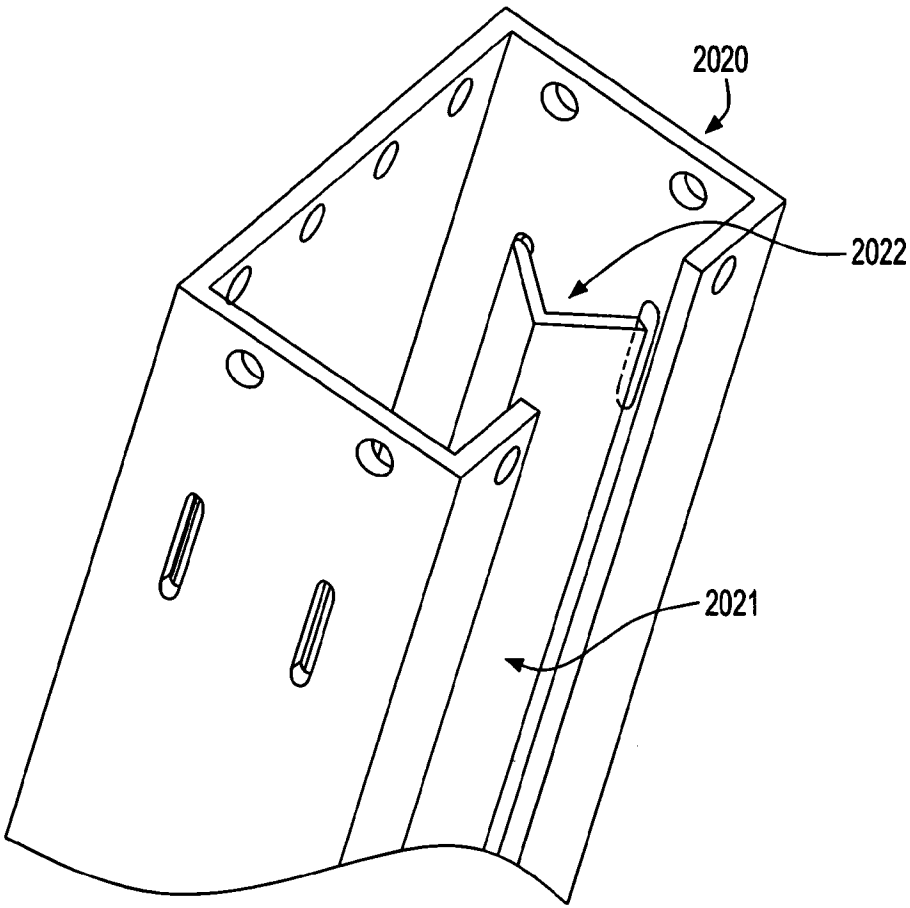
FIG. 16 illustrates a guide rail according to one embodiment of the invention.

FIGS. 15-17 show another embodiment of a guide rail 2020 (FIG. 16) and a bearing system 2030 (FIGS. 15 & 17) according to the invention. The guide rail 2020 is generally the same as that described above with respect to the guide rail 1020 shown in FIG. 11 except that the guide rail 2020 includes an inverted V-rail 2022 that extends along the interior surfaces of the guide rail 2020 that are perpendicular to the slotted channel 2021 of the guide rails 2020. The bearing system 2030 shown in FIG. 17 comprises a set of V-grooved wheels 2031 within a plate housing 2032. A bearing link 2036 extends from a central portion of the plate housing 2032. A drilled plate 2053 is permanently attached to the bearing link. This drilled plate 2053 engages with the platform side arm 2051 and receiving plate 2052 to form the platform angular adjustment system 2050, similar to as in previous embodiments, which maintains the desired angle of inclination of the platform 1040.

In practice, the lift 1000 having the guide rail 2020 and bearing system 2030 of FIGS. 15-17 operates generally the same as that described above with respect to FIGS. 5-14. The only difference is that as the hydraulic cylinder 1061 is operated to move the V-grooved wheels 2031 within the plate housing 2032 along the inverted V-rails 2022 of the guide rails 2020 in order to lift the platform 1040. The platform 1040 is otherwise connected to the bearing system 2030 via the platform angular adjustment system 2050 and bearing link 2036 similar to that described above with reference to FIGS. 5-14.

Figure 18:
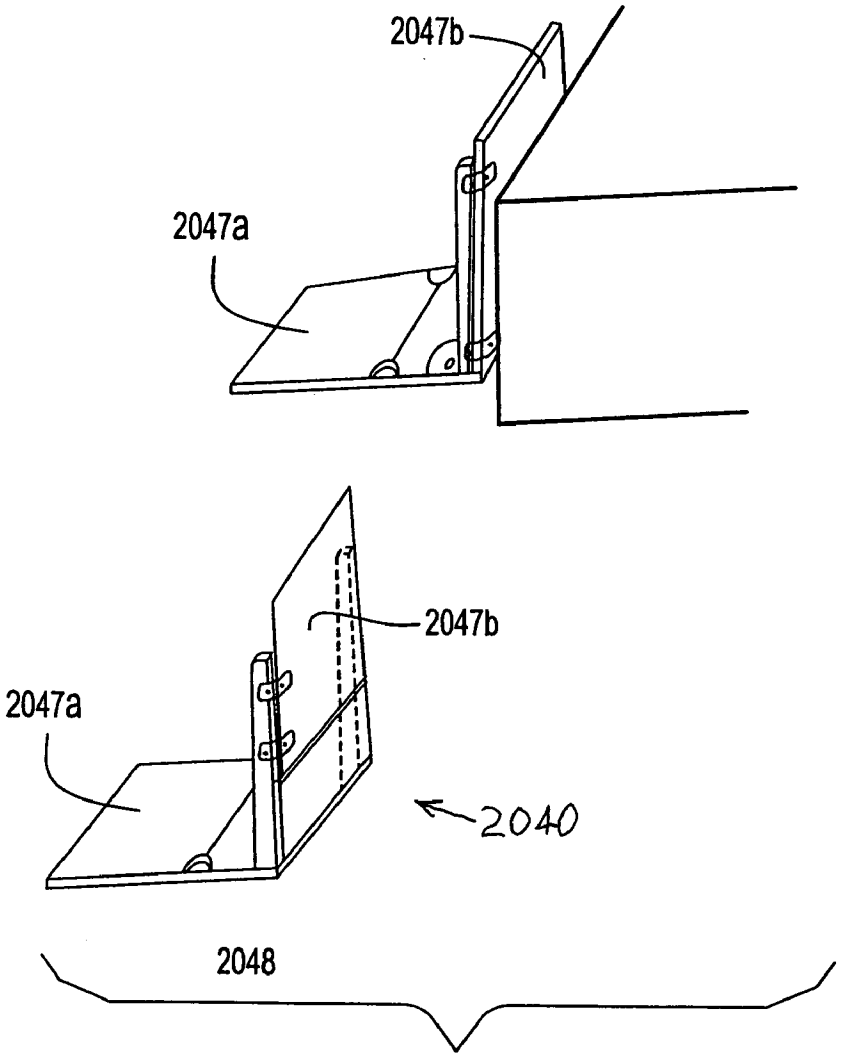
FIG. 18 illustrates an embodiment of a sectional platform according to the invention.

FIG. 18 illustrates another embodiment of a platform 2040 according to the invention. The platform 2040 shown in FIG. 18 is generally similar to the tubular frame covered by sheet metal as above, but is comprised of multiple sections 2047*a*, 2047*b*, 2047*c*, and 2047*d* as well as rigid support beams 2047*e*. The two panels 2047*b* and 2047*c* together make up a combination exit door and exit ramp, 2047*b* being hinged along the vertical on one of the two support beams 2047*e*, and 2047*c* being hinged on the horizontal along the platform floor 2047*d*. Section 2047*a* may be folded up for compactness in storage and transport owing that the rigid beams 2047*e* make impractical the pivoting of the platform to the vertical for collapse. The artisan will realize that modular panels and doors may be attached to the rigid support beams 2047*e* such that a full four-sided enclosure of panels, doors, and ramps is provided for retention of the occupant within the device.

Figure 19:
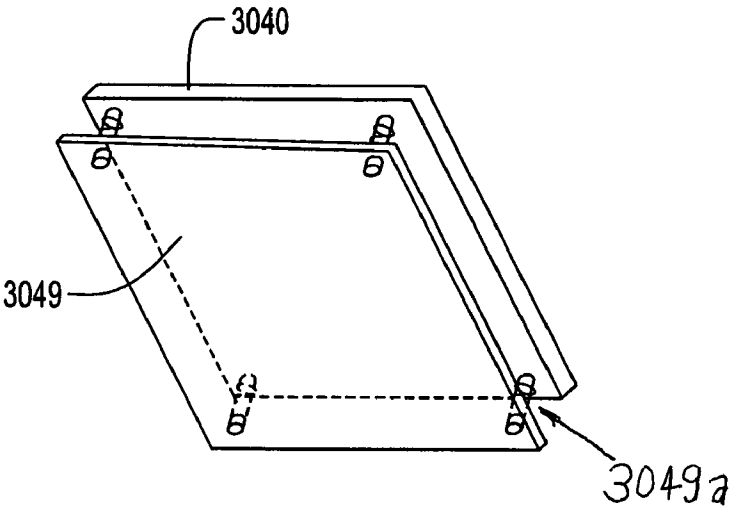
FIG. 19 illustrates an embodiment of a platform having an obstruction detection system according to the invention.

FIG. 19 illustrates yet another embodiment of a platform 3040 according to the invention. The platform 3040 shown in FIG. 19 is a generally solid platform, although the artisan will appreciate that non-solid platforms as described earlier herein may be used as well according to the invention. The primary distinction of the platform 3040 from the earlier described platforms is the obstruction detection shield 3049. The obstruction detection shield 3049 is connected to an underside of the platform 3040 via springs 3049*a* having safety switches incorporated therein. The safety switches trip as soon as a spring 3049*a* compresses beyond an acceptable level indicating that the surface onto which the platform 3049 is attempting to be placed upon has some obstructions. As a result, power provided to the lift 1000 would be stopped until the obstructions were removed. In this manner, a safe transport of the wheelchair occupant from one level to another is rendered more likely. Likewise, the safety of passers by and of property which may obstruct the path of the platform may also be better protected according to this embodiment of the invention.

The various exemplary embodiments of the invention as described hereinabove do not limit different embodiments of the present invention. The materials described herein are not limited to the materials, designs, or shapes referenced herein for illustrative purposes only, and may comprise various other materials, designs or shapes suitable for the systems and methods described herein as should be appreciated by one of ordinary skill in the art.

Alternative power systems may be used to raise and lower the platform according to the systems and methods of the invention. For example, each guide rail could further comprise a power screw that engages a nut provided in a corresponding one of the bearing blocks. The power screw may be a ball thread type screw as is common in the art. Rotation of the power screws raises or lowers the platform as desired. The power screws may be driven by separate synchronous motors provided at a top of each respective guide rail, or the power screws may instead be driven by a single motor whereby the power is transmitted from a primary power screw to a secondary power screw via bevel gears and a drive shaft, or by a chain and sprocket set, running at the lower frame at the bottom of the guide rails.

While there has been shown and described what is considered to be preferred embodiments of the invention, it will, of course, be understood that various modifications and changes in form or detail could readily be made without departing from the spirit or scope of the invention. It is therefore intended that the invention be not limited to the exact forms described and illustrated herein, but should be construed to cover all modifications that may fall within the scope of the appended claims.

What is claimed is:

1. A wheelchair lift comprising:

a base;

a pair of guide rails extending upwardly from the base, the guide rails being adjustable between vertical and inclined positions;

a movable platform suspended between the guide rails;

a bearing system housed within each guide rail for linearly translating the platform;

a transmission system for moving the bearing systems;

a platform angular adjustment system that rotatably attaches the platform with the bearing system to maintain the platform in a horizontal position parallel with the base notwithstanding the vertical or inclined position of the guide rails, wherein the bearing system raises or lowers the platform by operation of the power transmission system;

the base comprises a pair of bi-furcated legs, each bi-furcated leg having a first section pivotably connected to a second section of a respective one of the bi-furcated legs, the bi-furcated legs being generally parallel to one another;

the base comprises a cross-member extending perpendicularly between and attached to the bi-furcated legs:

wherein each guide rail is further comprised of a generally closed tubular member except for a longitudinal channel extending along one side of each respective guide rail, the longitudinal channel of each respective guide rail facing the platform;

a telescoping brace connecting a respective one of the guide rails to a corresponding one of the first sections of the base, the telescoping brace being retracted when the guide rails are in the vertical position and being extended as the guide rails are inclined;

wherein each bearing system further comprises a bearing block that slides inside a respective one of the guide rails, each bearing block having a bearing link extending from a respective one of the bearing blocks such that each bearing link projects beyond the longitudinal channel of a respective one of the guide rails;

wherein each bearing block further comprises rollers in opposing relation to each other for sliding the bearing block within a respective one of the guide rails;

wherein the guide rails each further comprise an inverted V-channel extending longitudinally along an interior of the guide rails, and the rollers of the bearing blocks further comprise V-grooved wheels that slide along the inverted V-channels of the guide rails; and wherein each platform angular adjustment system further comprises a platform side arm extending upward from opposed sides of the platform, a receiving plate spaced apart from the platform side arm, and a drilled plate that is fitted in the space between the platform side arm and the receiving plate, the platform side arm, the receiving plate and the drilled plate having holes that, when aligned, receive a pin to rigidly attach the platform to the platform angular adjustment system, each drilled plate having a cuff that receives the bearing link to rotatably attach the platform to the bearing systems.

2. The wheelchair lift according to claim 1, wherein each first section further comprises a first end, a second end, an upper surface, and an underside and each second section further comprises a first end, a second end, an upper surface and an underside, the second end of the first section being pivotably connected to the first end of the second section of each respective bi-furcated leg.

3. The wheelchair lift according to claim 2, wherein each first section further comprises rollers on the underside thereof, and a cut-out in an upper surface thereof, the cut-out for receiving a respective one of the guide rails in the vertical or inclined positions.

4. The wheelchair lift according to claim 1, wherein the power transmission system further comprises a hydraulic cylinder mounted to an outside surface of one of the guide rails, a plurality of idler pulleys variously positioned relative to the hydraulic cylinder and guide rails, and a cable attached at one end to the hydraulic cylinder and at another end to one of the bearing blocks of the bearing system, the cable traversing over the plurality of idler pulleys to move the bearing block.

5. The wheel chair lift of claim 4, wherein the second sections of the bi-furcated legs, the platform, and the guide rails are vertically oriented and parallel to one another to comprise a collapsed storage state for the lift, whereby the rollers on the underside of the first sections of the bi-furcated legs provide mobility to the lift.

6. The wheelchair lift according to claim 1, wherein the platform further comprises a grid of tubular members having opposed ends, opposed sides, a longitudinal interior member extending between the opposed ends, and a plurality of lateral interior members extending between the opposed sides.

7. The wheelchair lift according to claim 1, wherein the platform further comprises a brace extending from each one of the side bearing arms to a respective one of the opposed sides of the platform.

8. The wheelchair lift of claim 7, further comprising outriggers extending from the first ends of the first sections of the bi-furcated legs of the base.

9. The wheelchair lift of claim 8, wherein the outriggers further comprise a telescopic longitudinal adjustment and a leveling foot.

10. The wheelchair lift of claim 1, further comprising a guide rail upper brace extending from each guide rail to be set upon inclination of the guide rails.

11. The wheelchair lift of claim 1, wherein the platform is a substantially solid panel comprised of sheet metal, steel, wood, or other substantially solid material.

12. The wheelchair lift of claim 11, wherein the platform is further comprised of several modular or hinged sections connected to one another or to a rigid support beam in order to provide guarding on up to four sides which will prevent accidental contact with the lift mechanisms or unintended exit from the lift platform by the occupant.

13. The wheelchair lift of claim 11, wherein the platform further comprises an obstruction detection device.

14. The wheelchair lift of claim 13, wherein the obstruction detection device further comprises a panel attached below a lower surface of another panel by springs having safety trip switches for halting movement of the platform when an object is detected.

15. The wheelchair lift of claim 1, wherein a weight of the base is greater than a combined weight of any components of the lift to add balance and stability to the lift even when the guide rails are inclined.

* * * * *